US009001017B2

(12) United States Patent
Moon et al.

(10) Patent No.: US 9,001,017 B2
(45) Date of Patent: Apr. 7, 2015

(54) LIQUID CRYSTAL DISPLAY DEVICE USING A MINI-LVDS METHOD

(75) Inventors: Myung Kook Moon, Daegu (KR); Hyun Taek Nam, Daegu (KR); Jong Woo Kim, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 29 days.

(21) Appl. No.: 13/291,572

(22) Filed: Nov. 8, 2011

(65) Prior Publication Data

US 2012/0133847 A1 May 31, 2012

(30) Foreign Application Priority Data

Nov. 26, 2010 (KR) ..... 10-2010-0119068

(51) Int. Cl.
*G09G 3/36* (2006.01)

(52) U.S. Cl.
CPC ..... *G09G 3/3611* (2013.01); *G09G 2310/08* (2013.01); *G09G 2370/08* (2013.01); *G09G 2370/14* (2013.01)

(58) Field of Classification Search
CPC ..... G09G 3/3611–3/3696; G09G 3/006–3/04; G09G 3/06–3/18; G09G 3/20–3/2096; G09G 3/22; G09G 3/3225–3/3291; G09G 3/34–3/3426; G09G 2300/04–2300/085; G09G 2310/00–2310/08; G09G 2320/00–2320/106; G09G 2340/00–2340/16
USPC ..... 345/87–104, 211–215, 690–699
See application file for complete search history.

(56) References Cited

U.S. PATENT DOCUMENTS

| | | | | |
|---|---|---|---|---|
| 8,405,785 | B1 * | 3/2013 | Auld et al. | 348/790 |
| 2004/0056852 | A1 * | 3/2004 | Shih et al. | 345/204 |
| 2006/0262065 | A1 * | 11/2006 | Luo et al. | 345/98 |
| 2009/0185579 | A1 | 7/2009 | Hong | |
| 2010/0149082 | A1 * | 6/2010 | Hong et al. | 345/88 |
| 2010/0231564 | A1 * | 9/2010 | Min et al. | 345/209 |

FOREIGN PATENT DOCUMENTS

TW 200934369 A 8/2009

OTHER PUBLICATIONS

Examination Statement dated Dec. 27, 2013 from the Taiwan Advance Patent & Trademark Office in counterpart application No. 100143450.

* cited by examiner

*Primary Examiner* — Sanghyuk Park
(74) *Attorney, Agent, or Firm* — Morgan, Lewis & Bockius LLP

(57) ABSTRACT

Disclosed is an LCD device in which a control signal is received and transmitted via a transmission line to be used for receiving and transmitting LVDS video signal between a timing controller and a source drive IC, the LCD device comprising a liquid crystal display panel for display an image; a data driver for driving data lines of the liquid crystal display panel through a plurality of source drive ICs; and a timing controller for outputting a packet signal obtained by combining a control signal and video signal to the source drive IC, wherein the source drive IC separates and outputs the control signal and video signal from the packet signal transmitted from the timing controller.

8 Claims, 6 Drawing Sheets

LIQUID CRYSTAL DISPLAY DEVICE USING A MINI-LVDS METHOD

CROSS REFERENCE TO RELATED APPLICATIONS

This application claims the benefit of the Korean Patent Application No. 10-2010-0119068 filed on Nov. 26, 2010, which is hereby incorporated by reference as if fully set forth herein.

BACKGROUND OF THE INVENTION

1. Field of the Invention

The present invention relates to a liquid crystal display (LCD) device, and more particularly, to an LCD device including a timing controller with the decreased number of pins.

2. Discussion of the Related Art

With the recent development of information technology (IT), a flat display device has attracted great attention as the visual information communication medium. For strengthening the competitiveness, it is important for the flat display device to realize various advantages such as low power consumption, thin profile, lightness in weight, and high picture quality.

A typical example of the flat display device, liquid crystal display (LCD) device, displays an image by the use of optical anisotropy of liquid crystal. The LCD device has advantages of thin profile, small size, low power consumption, and high picture quality.

The LCD device individually supplies video information to respective pixels arranged in a matrix configuration, whereby light transmittance of the pixels are adjusted and thus desired image is displayed thereon. Thus, the LCD device includes a liquid crystal display panel in which the pixels serving as the minimum unit for displaying the image are arranged in the active matrix configuration; and a driver for driving the liquid crystal display panel. Also, since the LCD device cannot emit light in itself, the LCD device necessarily requires a backlight unit for supplying the light. The driver includes a timing controller, a gate driver, and a data driver.

FIG. 1 is an exemplary view illustrating a pin connection structure between a timing controller and a source drive IC in a related art LCD device. FIG. 2 is an exemplary view illustrating a waveform in a control signal and a video signal outputted from a timing controller in a related art LCD device.

The related art LCD device includes a timing controller 14, a gate driver (not shown), a data driver (not shown), and a liquid crystal display panel (not shown). The timing controller 14 outputs a gate control signal and a data control signal for respectively controlling gate and data drivers; and samples and rearranges digital video data (RGB); and outputs the sampled and rearranged data. The gate driver supplies a scan pulse to each gate line of the liquid crystal display panel in response to the gate control signal. The data driver supplies a pixel signal to each data line of the liquid crystal display panel in response to the data control signal. The liquid crystal display panel includes a plurality of liquid crystal cells driven by the scan pulse and pixel signal, to thereby display image. At this time, the data driver includes a plurality of source drive ICs (or data drive ICs) 17.

The timing controller 14 outputs the gate control signal for controlling the gate driver and the data control signal controlling the data driver by the use of vertical/horizontal synchronous signals and clock signals supplied from a system. Also, the timing controller 14 samples and rearranges the digital video data (video signal, RGB) transmitted from the system, and then supplies the sampled and rearranged video data to the data driver.

The data driver includes a plurality of source drive ICs 17 for receiving the video signal from the timing controller 14, and driving the data line of the liquid crystal display panel.

In the related art LCD device, the timing controller (T-Con) 14 separates the video signal of mini-LVDS and control signal from each other, and supplies the separated signals to the source drive IC 17, thereby causing the increased number of pins in the timing controller 14.

In the timing controller 14, as shown in FIG. 1, there are 14 pins for transmitting the video signal (mini-LVDS) to the source drive IC (FHD reference), and 5 pins for transmitting the control signal (SOE, POL, POL2, CSC, H2, and etc.) to the source drive IC. Thus, the video signal and control signal outputted from the timing controller 14 have different 19 waveforms, as shown in FIG. 2.

Also, since the source drive IC 17 receives the separated video signal and control signal, the source drive IC 17 requires the pins whose number is the same as those of the timing controller 14.

That is, in case of the related art LCD device, the video signal and control signal are received and transmitted while being separated from each other, whereby each of the timing controller 14 and source drive IC 17 requires 19 pins. Thus, the timing controller 14 and source drive IC 17 are increased in size.

In the related art LCD device, the video signal and control signal are transmitted via the large-numbered pins and lines formed between the timing controller 14 and source drive IC 17, which might cause the increased loss of pin and package.

SUMMARY OF THE INVENTION

Accordingly, the present invention is directed to an LCD device that substantially obviates one or more problems due to limitations and disadvantages of the related art.

An aspect of the present invention is to provide an LCD device in which a control signal is received and transmitted via a transmission line to be used for receiving and transmitting LVDS video signal between a timing controller and a source drive IC.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an LCD device comprising: a liquid crystal display panel for display an image; a data driver for driving data lines of the liquid crystal display panel through a plurality of source drive ICs; and a timing controller for outputting a packet signal obtained by combining a control signal and video signal to the source drive IC, wherein the source drive IC separates and outputs the control signal and video signal from the packet signal transmitted from the timing controller.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings.

Wherever possible, the same reference numbers will be used throughout the drawings to refer to the same or like parts.

Hereinafter, an LCD device according to the present invention will be described with reference to the accompanying drawings.

Figure 3:
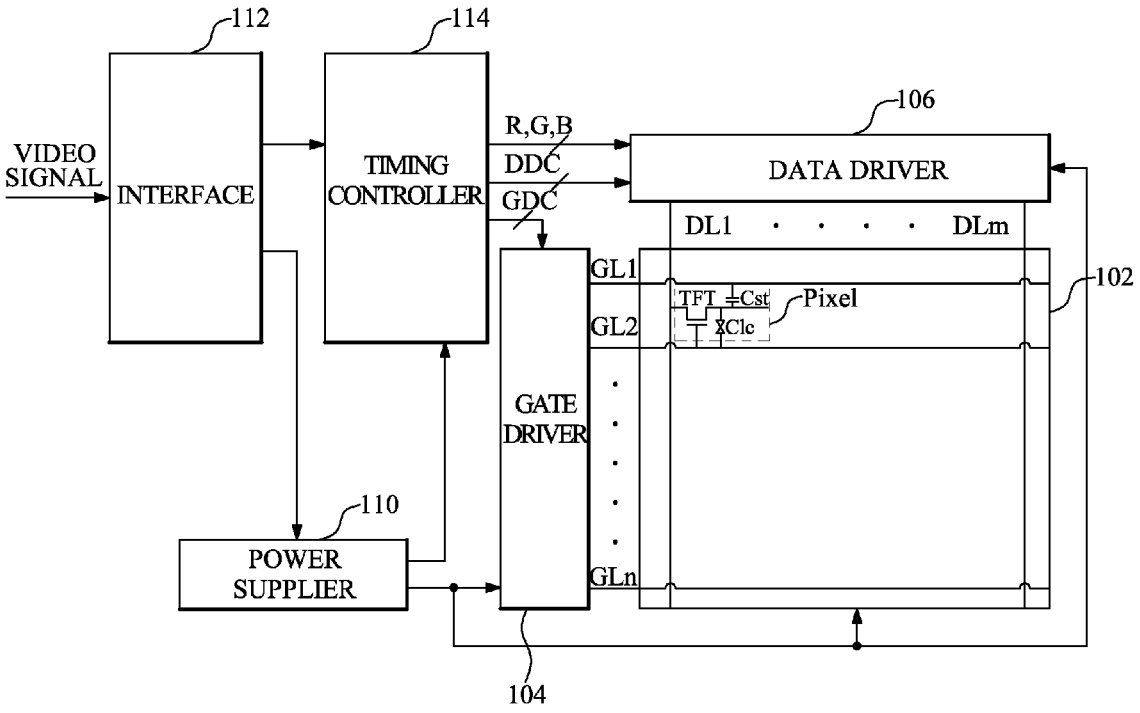
FIG. 3 illustrates an LCD device according to an embodiment of the present invention.

FIG. 3 illustrates an LCD device according to an embodiment of the present invention.

As shown in FIG. 3, the LCD device according to the embodiment of the present invention includes a timing controller 114, a gate driver 104, a data driver 106, a liquid crystal display panel 102, and a power supplier 110. The timing controller 114 outputs a gate control signal (GDC) and a data control signal (DDC) for respectively controlling gate and data drivers 104 and 106; and samples and rearranges digital video data (RGB, hereinafter, referred to as 'video signal'); and outputs the sampled and rearranged video signal. The gate driver 104 supplies a scan pulse to each gate line (GL1~GLn) of the liquid crystal display panel 102 in response to the gate control signal (GDC). The data driver 106 supplies a pixel signal to each data line (DL1~DLm) of the liquid crystal display panel 102 in response to the data control signal (DDC). The liquid crystal display panel 102 includes a plurality of liquid crystal cells driven by the scan pulse and pixel signal, to thereby display an image. The power supplier 110 supplies power for driving the above elements.

The timing controller 114 outputs the gate control signal (GDC) for controlling the gate driver 104 and the data control signal (DDC) for controlling the data driver 106 by the use of vertical/horizontal synchronous signals and clock signals supplied from a system (not shown). Also, the timing controller 114 samples and rearranges the video signal inputted from the system (not shown), and then supplies the sampled and rearranged video signal to the data driver 106.

The gate driver 104 sequentially supplies the scan pulse (gate pulse or gate-on signal) to each gate line (GL1~GLn) in response to the gate control signal (GDC) transmitted from the timing controller 114, to thereby turn-on thin film transistors (TFTs) of a corresponding horizontal line.

The data driver 106 converts the data control signal (DDC) transmitted from the timing controller 114 into an analog pixel signal (data signal or data voltage) corresponding to a grayscale value of the video signal (RGB) in response to the data control signal (DDC) transmitted from the timing controller 114; and supplies the analog pixel signal to the data line (DL1~DLm) of the liquid crystal display panel 102.

The liquid crystal display panel 102 includes the plurality of liquid crystal cells (Clc) arranged in a matrix configuration; and the thin film transistors (TFTs) formed at respective crossing portions of the gate lines (GL1~GLn) and data lines (DL1~DLm) and respectively connected with the liquid crystal cells (Clc), to thereby display image.

In the LCD device with the above structure, the timing controller 114 receives the vertical/horizontal synchronous signals (Vsync, Hsync), clock signals (DCLK), data enable signal (DE), and video signal from the system (not shown) via an interface 112.

The interface 112 converts analog video signal to digital video signal, and detects a synchronization signal included in the video signal. At this time, the video signal transmitted from the system is supplied to the timing controller 114 by the use of low-voltage differential signaling (LVDS) method.

Figure 4:
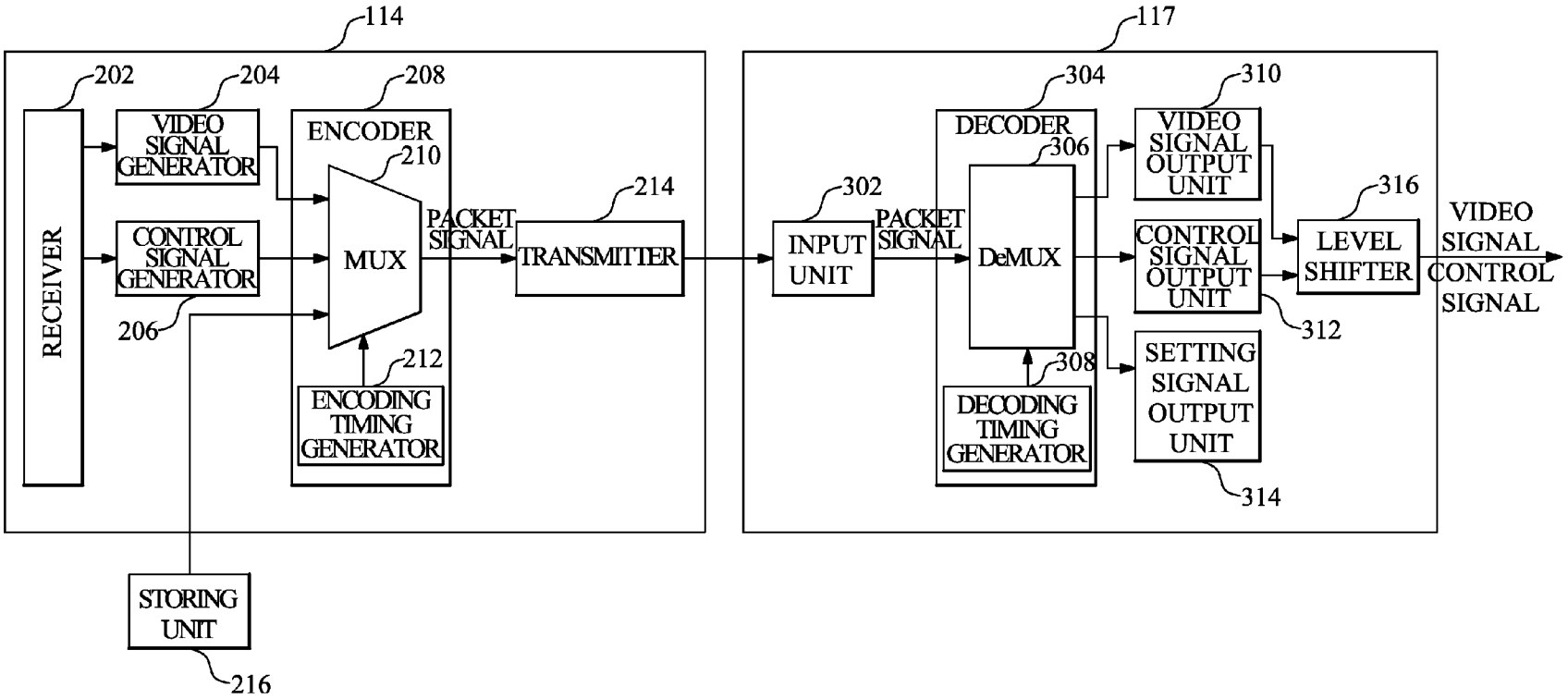
FIG. 4 is an exemplary view illustrating an inner structure in a timing controller and a source drive IC of an LCD device according to the present invention.

FIG. 4 is an exemplary view illustrating an inner structure in the timing controller and source drive IC of the LCD device according to the present invention.

The timing controller 114 of the present invention rearranges the compressed video signal supplied from the system, and transmits the rearranged signal to the source drive IC 117. Also, the timing controller 114 generates the gate control signal (GDC) and the data control signal (DDC) by the use of vertical/horizontal synchronous signals (Vsync/Hsync) and data enable signal (DE), and transmits the generated gate control signal (GDC) and data control signal (DDC) to the gate driver 104 and data driver 106.

For this, as shown in FIG. 4, the timing controller 114 includes a receiver 202 for receiving the data from the system; a video signal generator 204 for rearranging and outputting the video signal among the various signals transmitted from the receiver 202; a control signal generator 206 for generating the control signals to control the gate driver 104 and data driver 106; an encoder 208 for generating a packet signal by combining the control signal to be transmitted to the source drive IC 117 among the control signals transmitted from the control signal generator 206 with the video signal generated in the video signal generator 204 at the timing of the video signal; and a transmitter 214 for transmitting the packet signal to the source drive IC 117.

The receiver 202 receives the various signals (for example, clock signal (CLK), horizontal synchronous signal (Hsync), vertical synchronous signal (Vsync), and data enable (DE)) and the compressed video signal.

The control signal generator 206 generates the gate control signal (GDC) and the data control signal (DDC) by the use of various signals received via the receiver 202.

The video signal generator 204 rearranges and outputs the compressed video signal received via the receiver 202.

The encoder 208 combines the input video signal, control signal and setting signal at the proper timing, and then outputs the combined signal. The above three signals are inputted to the encoder 208. First, the encoder 208 receives the RGB video signal (image data), wherein the video signal includes information for displaying the image. Second, the encoder 208 receives the control signal, wherein the control signal is for controlling the source drive IC 117, for example, SOE, POL1, POL2, CSC, and etc. Third, the encoder 208 receives the source drive IC setting signal (which will be shortly referred to as 'setting signal'), wherein the setting signal is for setting the source drive IC, for example, power mode (PWRC1, 2, 3), pair setting (PAIR), and etc. The setting signal may be transmitted from a storing unit (EEPROM) 216 to the encoder 208, wherein the storing unit (EEPROM) 216 may be included in the timing controller 114 or separately provided from the timing controller 114.

As shown in FIG. 4, the encoder 208 includes a MUX 210 and an encoding timing generator 212. The MUX 210 combines the aforementioned three signals (video signal, control signal, and setting signal); and informs the combining timing of the video signal, control signal, and setting signal so as to realize the packet of the three signals. That is, the encoding timing generator 212 informs the time point for combining the control signal with the video signal or outputting the control signal to be combined with the video signal, whereby the control signal is combined with the video signal. The MUX combining the video signal and the control signal will be explained with reference to FIG. 5.

The transmitter 214 outputs the packet signal generated in the encoder 208 to the source drive IC 117.

Then, the source drive IC 117 receives the packet signal outputted from the timing controller 114; and then separates the three signals, that is, video signal, control signal, and setting signal from the received packet signal. That is, the source drive ICI 117 is opposite in function to the timing controller 114.

For this, as shown in FIG. 4, the source drive IC includes an input unit 302 for receiving the packet signal from the timing controller 114; a decoder 304 for separating the video signal, control signal, and setting signal from the packet signal; a video signal output unit 310 for outputting the video signal separated by the decoder 304; a control signal output unit 312 for outputting the control signal separated by the decoder 304; a setting signal output unit 314 for outputting the setting signal separated by the decoder 304; and a level shifter 316 for amplifying and outputting the signals outputted from the video signal output unit 310 and control signal output unit 312.

The input unit 302 receives the packet signal from the timing controller 114.

The decoder 304 separates the control signal included in the packet signal from the video signal at the proper timing. That is, the decoder 304 separates the video signal, control signal, and setting signal from the packet signal.

For this, as shown in FIG. 4, the decoder 304 includes a DeMUX 306 and a decoding timing generator 308. A method for separating the control signal from the video signal by the DeMUX 306 will be explained with reference to FIG. 5.

The video signal output unit 310, control signal output unit 312, and setting signal output unit 314 respectively output the video signal, control signal, and setting signal generated in the decoder 304. The level shifter 316 amplifies the signals outputted from the respective output units.

Figure 5:
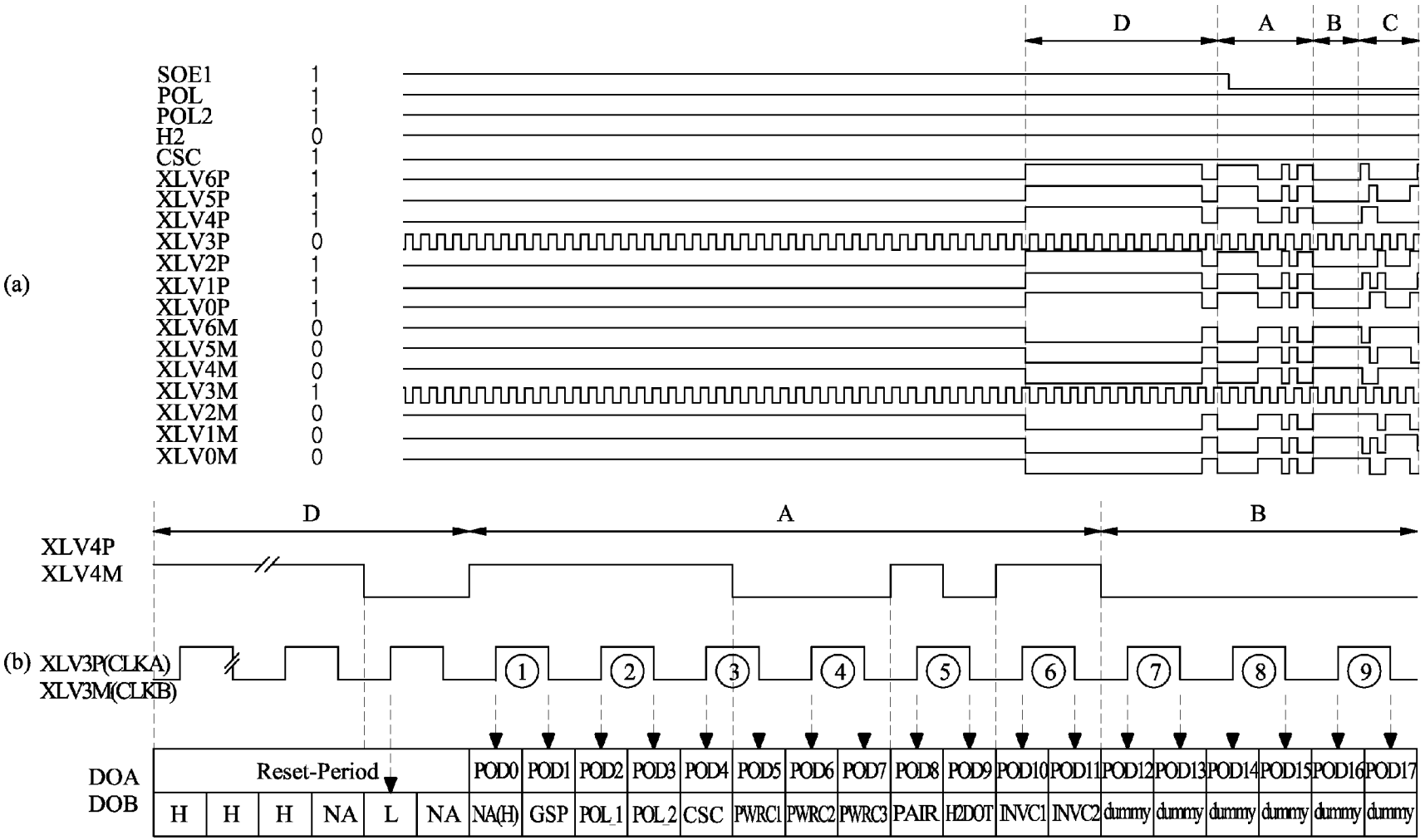
FIG. 5 is an exemplary view illustrating a waveform in a packet signal outputted from a timing controller of an LCD device according to the present invention.
Figure 6:
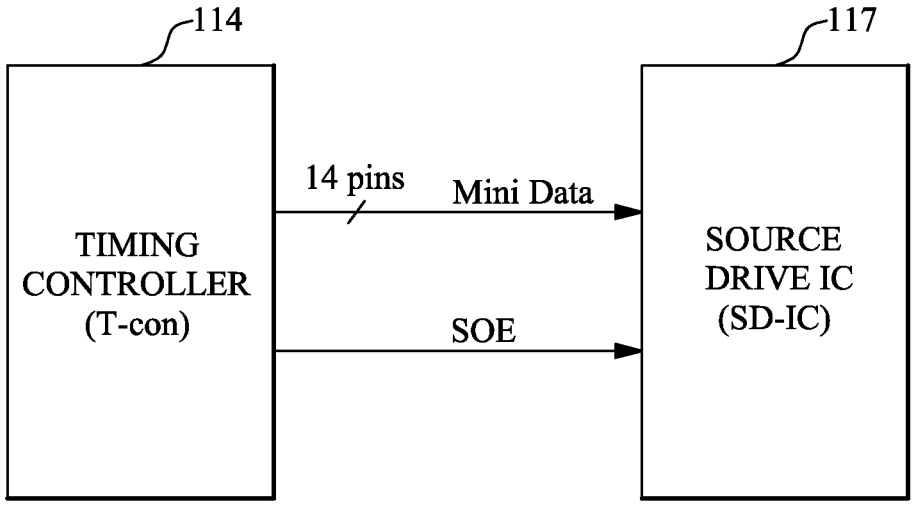
FIG. 6 is an exemplary view illustrating a pin connection structure between a timing controller and a source drive IC in an LCD device according to the present invention.

FIG. 5 is an exemplary view illustrating a waveform in the packet signal outputted from the timing controller of the LCD device according to the present invention, wherein the waveform corresponds to an output waveform in the timing controller, and also corresponds to an input waveform in the source drive IC. FIG. 6 is an exemplary view illustrating a pin connection structure between the timing controller and the source drive IC in the LCD device according to the present invention.

Before the video signal is transmitted to the source drive IC 117 via a transmission line, the control signal is transmitted via the transmission line by the use of timing controller 114 of the present invention, as mentioned above.

At this time, among the control signals transmitted to the source drive IC 117, POL, POL2, CSC and H2 except SOE are included in all the video signal (mini-LVDS), and are then transmitted in the pattern of packet signal. That is, the control signals transmitted to the source drive IC 117 may include the source output enable signal (SOE) for controlling the data output period of each source drive IC (D-IC); vertical polarity control signal (POL) for controlling the polarity of output data; and charge-sharing control signal (CSC) for controlling the charge-sharing of the horizontal polarity control signal (H1/H2DOT) and data lines. Among the above signals, POL, POL2, CSC and H2 are included in all the video signal (mini-LVDS), and are then transmitted in the pattern of packet signal.

For this, as shown in (a) of FIG. 5, before the video signal (mini-LVDS) is transmitted via 14 pins (or transmission lines) for transmitting the video signal, the control signal (POL, POL2, CSC, H2DOT) is transmitted. In this case, the video signal including the control signal is referred to as the packet signal. The packet signal may include the setting signal (PWRC, PAIR, INVC).

That is, as shown in FIG. 5, the packet signal may include a reset-signal region (D) including the reset signal; a control signal region (A) including the control signal; a dummy signal region (B) including a dummy signal; and a video signal region (C) including the video signal.

Figure 1:
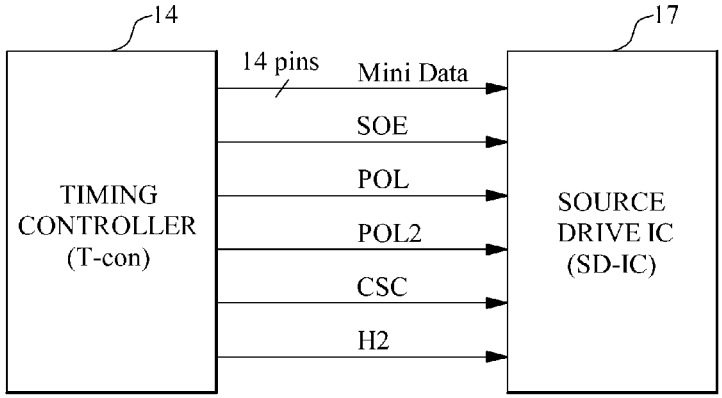
FIG.1 Related Art
FIG. 1 is an exemplary view illustrating a pin connection structure between a timing controller and a source drive IC in a related art LCD device.
Figure 2:
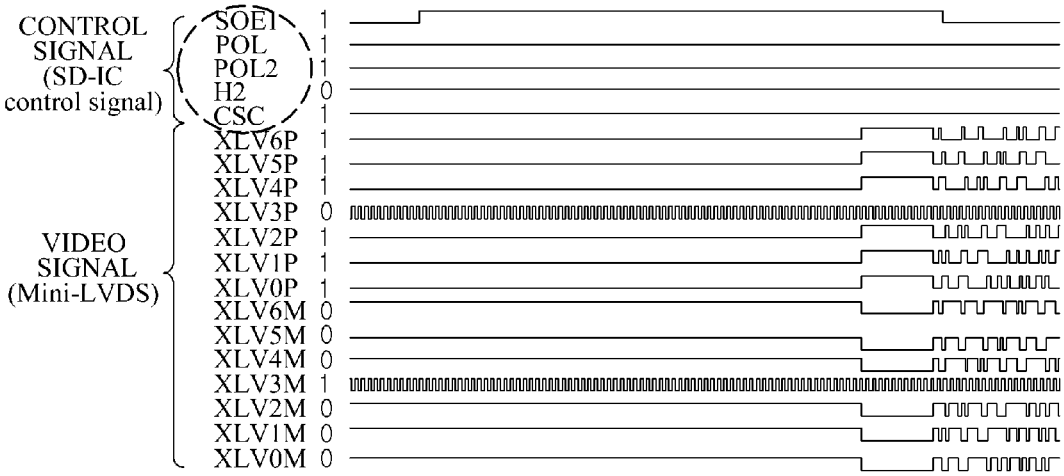
FIG.2 Related Art
FIG. 2 is an exemplary view illustrating a waveform in a control signal and a video signal outputted from a timing controller in a related art LCD device.

As mentioned above, since the control signal is outputted while being included in the video signal, it is unnecessary to provide an additional pin for outputting the control signal. That is, as shown in FIG. 6, the timing controller 114 and the source drive IC 117 of the present invention require 14 pins for transmitting the packet signals, and 1 pin for transmitting the SOE among the control signals, that is, the timing controller 114 and the source drive IC 117 of the present invention require totally require 15 pins. Thus, the number of pins for the timing controller 114 and source drive IC 117 may be decreased by 4 pins, as compared to those of the related art LCD device shown in FIG. 1. Also, the setting signal is outputted while being included in the video signal, to thereby decrease a size of PCB.

While the related art timing controller transmits the control signal and video signal to the source drive IC by the use of 19 pins, the timing controller 114 of the present invention transmits the control signal and video signal to the source drive IC by the use of 15 pins.

A structure of the packet signal outputted from the timing controller 114 of the present invention will be explained in detail with reference to (a) and (b) of FIG. 5. Meanwhile, as shown in (a) of FIG. 5, supposing that the POL1 has a high level(1), POL2 has a high level(1), H2 has a low level(0), and CSC has a high level(1).

First, the timing controller 114, and more particularly, the encoder 208 outputs the POL1 control signal of the high level as the packet signal during a rising period from the low level of first clock (①) to the high level of second clock (②) after an end of the reset signal of the reset signal region (D).

Then, the encoder 208 outputs the POL2 of the high level as the packet signal during a falling period from the high level of second clock (②) to the low level.

Then, the encoder 208 outputs the CSC control signal of the high level during a rising period from the low level of second clock (②) to the high level of third clock (③).

Finally, the encoder 208 outputs the H2DOT control signal of the low level as the packet signal during a falling period from the high level of fifth clock (⑤) to the low level.

That is, as mentioned above, during the period when the clock is changed from the high level to the low level or from the low level to the high level, the timing controller 114 selectively outputs the four control signals as the packet signal.

Also, the timing controller 114 may output the setting signals such as NA(H); PWRC1, 2, 3; PAIR; and INVC 1, 2, as the packet signal by the same method as the above method for outputting the control signal as the packet signal.

The timing controller 114 enables to include the control signal in the control signal region (A) through the above processes. Then, for the sequential dummy signal region (B), the dummy signals of the low level are outputted as the packet signal, to thereby divide the sequential video signal region (C) and control signal region (A) after the dummy signal region (B).

For the above matching, the timing controller 114 stores matching information about the clock during which the control signal is being included in the packet signal. This matching information is also stored in the source drive IC 117, whereby it is possible to separate the control signal and video signal from the packet signal by the use of source drive IC.

That is, when the video signal including the control signal or setting signal is outputted as the packet signal, and is then transmitted to the source drive IC 117 through the above processes, the source drive IC 117 carries out the reverse process to the above, to thereby separate the video signal, control signal, and setting signal from the packet signal.

For example, the source drive IC 117, and more particularly, the decoder 304 separates the POL1 control signal of the high level from the packet signal, and transmits the POL1 control signal to the control signal output unit 312 during a rising period from the low level of first clock to the high level of second clock (②); and transmits the POL1 control signal to the control signal output unit 312.

Then, the decoder 304 separates the POL2 control signal of the high level from the packet signal during a falling period from the high level of second clock (②) to the low level; and transmits the POL2 control signal to the control signal output unit 312.

Then, the decoder 304 separates the CSC control signal of the high level from the packet signal during a rising period from the low level of second clock (②) to the high level of third clock (③); and transmits the CSC control signal to the control signal output unit 312.

Finally, the decoder 304 separates the H2DOT control signal of the low level from the packet signal during a falling period from the high level of fifth clock (⑤) to the low level; and transmits the H2DOT control signal to the control signal output unit 312.

After that, the period of outputting seventh clock (⑦), eighth clock (⑧), and ninth clock (⑨), it is regarded as the dummy signal region (B), whereby the decoder 304 transmits the signals outputted at the clock after the dummy signal region (B) to the video signal output unit 310.

That is, the above LCD device according to the present invention which applies the packet signal (Packet mini-LVDS) facilitates to perform the same function as the related art, and to decrease the number of pins of the timing controller.

In addition, the related art timing controllers serve as the interface with the source drive IC, and thus, the related art timing controllers transmit the video signals as mini-LVDS, and transmit the control signals as TTL output. However, in case of the present invention, the control signal (POL, POL2, CSC, H2, and D-IC option) and video signal are transmitted via the transmission line for transmitting the mini-LVDS signal corresponding to the video signal, to thereby decrease the number of pins in the timing controller 114 and source drive IC 117.

Figure 7:
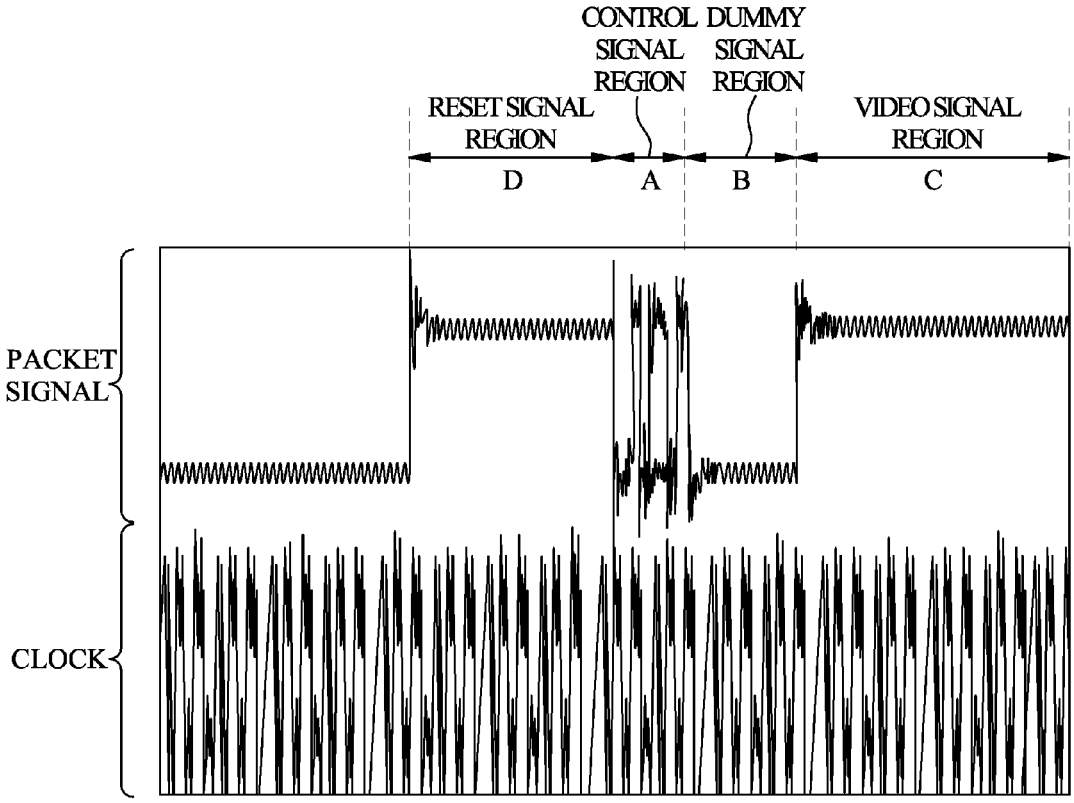
FIG. 7 is an exemplary view illustrating a simulation result of a waveform outputted from a timing controller of an LCD device according to the present invention.

FIG. 7 is an exemplary view illustrating a simulation result of a waveform outputted from the timing controller of the LCD device according to the present invention.

That is, as mentioned above, the packet signal transmitted from the timing controller 114 to the source drive IC 117 is divided into the reset signal region (D), control signal region (A), dummy signal region (B), and video signal region (C); and the control signal is transmitted together with the video signal, to thereby decrease the number of pins in the timing controller 114 and source drive IC 117 for the transmission of the control signal.

As mentioned above, before the video signal is transmitted to the source drive IC 117 via the transmission line to be used for transmitting the mini-LVDS video signal between the timing controller 114 and the source drive IC 117, to thereby decrease the number of pins of the timing controller 114 and the source drive IC 117. That is, it is possible to remove the four pins for receiving and transmitting the control signal such as POL, POL2, CSC, and H2 from each of the timing controller 114 and source drive IC 117.

Also, the source drive IC 117 is decreased in size. That is, the control signal and option signal of the source drive IC 117 are inputted via the pin for receiving the mini-LVDS video signal of the timing controller 114, whereby the source drive IC 117 is decreased in size.

According as the number of connection lines of PCB is decreased and the option resistance of the source drive IC 117 is removed, the PCB is decreased in size.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An LCD device, comprising:

a liquid crystal display panel configured to display an image;

a data driver configured to drive data lines of the liquid crystal display panel through a plurality of source drive ICs; and a timing controller configured to:

output a packet signal obtained by combining a control signal and video signal to one of the source drive IC via a plurality of transmission pins to be used for transmitting the video signal, the video signal being a mini-LVDS video signal; and output a source output enable signal SOE via a separate transmission pin other than the plurality of transmission pins, wherein the one of the plurality of source drive ICs is further configured to:

separate and output the control signal and video signal from the packet signal transmitted from the timing controller through the plurality of transmission pins used for transmitting the video signal, and receive the source output enable signal SOE through the separate transmission pin, wherein the timing controller is further configured to transmit the control signal to the source drive IC via the transmission pins before transmitting the video signal to the source drive IC, wherein the control signal includes a first vertical polarity control signal (POL), a second vertical polarity control signal (POL2), a charge-sharing control signal (CSC), and a horizontal polarity control signal (H2), and wherein the control signal, including the POL, POL2, CSC, and H2 signals, is transmitted on same transmission pins as the video signal.

2. The LCD device according to claim 1, wherein the packet signal is divided into:

a reset signal region configured to output a reset signal;

a control signal region configured to output the control signal; and a video signal region configured to output the video signal.

3. The LCD device according to claim 2, wherein a dummy signal region for outputting a dummy signal is between the control signal region and the video signal region.

4. The LCD device according to claim 1, wherein the timing controller includes:

a receiver configured to receive a plurality of signals from a system;

a video signal generator configured to rearrange and output the video signal among the signals transmitted from the receiver;

a control signal generator configured to generate control signals of controlling the data driver by the use of signals transmitted from the receiver;

an encoder configured to generate the packet signal by combining the control signal to be transmitted to the source drive IC among the control signals transmitted from the control signal generator with the video signal at a proper timing; and a transmitter configured to transmit the packet signal to the source drive IC.

5. The LCD device according to claim 4, wherein the encoder includes:

a MUX configured to combine the video signal with the control signal, and outputting the combined signal; and an encoding timing configured to inform the combining point of the video signal and control signal.

6. The LCD device according to claim 1, wherein the source drive IC includes:

an input unit configured to receive the packet signal from the timing controller;

a decoder configured to separate the video signal and control signal from the packet signal transmitted from the input unit;

a video signal output unit configured to output the video signal separated by the decoder;

a control signal output unit configured to output the control signal separated by the decoder; and a level shifter configured to amplify and output the video signal and control signal respectively outputted from the video signal output unit and control signal output unit.

7. The LCD device according to claim 6, wherein the decoder includes:

a DeMUX configured to separate the video signal and control signal, and outputting the separated video signal and control signal; and a decoding timing generator configured to inform the separating point of the video signal and control signal.

8. The LCD device according to claim 1, wherein the number of pins in the timing controller and source drive IC is decreased by the number of control signals included in the packet signal.

* * * * *